US009187279B2

(12) United States Patent
Nunokawa et al.

(10) Patent No.: US 9,187,279 B2
(45) Date of Patent: Nov. 17, 2015

(54) PRINTING DEVICE

(71) Applicant: SEIKO EPSON CORPORATION, Tokyo (JP)

(72) Inventors: Yohei Nunokawa, Nagano (JP); Yasuhiko Yoshihisa, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/445,794

(22) Filed: Jul. 29, 2014

(65) Prior Publication Data

US 2015/0035220 A1 Feb. 5, 2015

(30) Foreign Application Priority Data

Jul. 30, 2013 (JP) ..... 2013-157807

(51) Int. Cl.

| | |
|---|---|
| ***B65H 7/20*** | (2006.01) |
| ***B65H 31/02*** | (2006.01) |
| ***B65H 1/04*** | (2006.01) |
| ***B65H 5/26*** | (2006.01) |
| ***B41J 13/10*** | (2006.01) |

(52) U.S. Cl.

CPC ..... *B65H 7/20* (2013.01); *B41J 13/106* (2013.01); *B65H 1/04* (2013.01); *B65H 5/26* (2013.01); *B65H 31/02* (2013.01); *B65H 2301/4212* (2013.01); *B65H 2405/324* (2013.01); *B65H 2511/20* (2013.01); *B65H 2511/21* (2013.01); *B65H 2801/12* (2013.01)

(58) Field of Classification Search

CPC .... B65H 31/20; B65H 31/24; B65H 2403/41; B65H 2511/10; B65H 2405/324; B41J 13/106

USPC ..... 271/164, 213, 214

See application file for complete search history.

(56) References Cited

U.S. PATENT DOCUMENTS

| | | | | |
|---|---|---|---|---|
| 5,061,099 | A * | 10/1991 | Iwatani et al. | 400/625 |
| 5,149,218 | A * | 9/1992 | Iwatani et al. | 400/625 |
| 6,729,616 | B2 * | 5/2004 | Chen | 271/213 |
| 7,070,350 | B2 * | 7/2006 | Inokuchi et al. | 400/680 |
| 7,448,617 | B2 * | 11/2008 | Fujioka et al. | 271/207 |
| 7,584,959 | B2 * | 9/2009 | Kinoshita et al. | 271/214 |
| 7,597,317 | B2 * | 10/2009 | Okuda | 271/163 |
| 8,465,019 | B2 * | 6/2013 | Komuro et al. | 271/213 |
| 8,602,412 | B2 * | 12/2013 | Ma | 271/207 |
| 8,622,387 | B2 * | 1/2014 | Kuo et al. | 271/213 |
| 8,641,032 | B2 * | 2/2014 | Nakamura et al. | 271/9.05 |
| 2004/0013459 | A1 * | 1/2004 | Chen | 400/691 |

(Continued)

FOREIGN PATENT DOCUMENTS

JP 2004-338873 A 12/2004

*Primary Examiner* — Patrick Cicchino

(74) *Attorney, Agent, or Firm* — Global IP Couselors, LLP

(57) ABSTRACT

A printing device includes a printing mechanism configured to print a printing medium fed to a printing area in a device main body, a stacker configured to receive the printing medium discharged from the printing area, a drive device configured to cause a state of the stacker to be a housed state in which the stacker is housed in the device main body and a projecting state in which the stacker is positioned outside the device main body, and a control device configured to change the state of the stacker from the housed state to the projecting state by controlling the drive device. When a housing condition is established while the state of the stacker is the projecting state, the control device is configured to perform an automatic housing process to change the state of the stacker to the housed state by controlling the drive device.

7 Claims, 8 Drawing Sheets

(56) References Cited

U.S. PATENT DOCUMENTS

| | | | | |
|---|---|---|---|---|
| 2006/0204310 | A1* | 9/2006 | Inokuchi et al. | 400/680 |
| 2008/0308984 | A1* | 12/2008 | Dobashi et al. | 270/1.01 |
| 2010/0194036 | A1* | 8/2010 | Tsuchihashi | 271/279 |
| 2012/0175838 | A1* | 7/2012 | Nakamura et al. | 271/9.11 |
| 2013/0222504 | A1* | 8/2013 | Nakano et al. | 347/104 |
| 2013/0257960 | A1* | 10/2013 | Nakano et al. | 347/16 |
| 2013/0313772 | A1* | 11/2013 | Kuo et al. | 271/223 |
| 2013/0341853 | A1* | 12/2013 | Hsu | 271/145 |
| 2014/0021677 | A1* | 1/2014 | Nunokawa et al. | 271/9.08 |

* cited by examiner

PRINTING DEVICE

CROSS-REFERENCE TO RELATED APPLICATIONS

This application claims priority to Japanese Patent Application No. 2013-157807 filed on Jul. 30, 2013. The entire disclosure of Japanese Patent Application No. 2013-157807 is hereby incorporated herein by reference.

BACKGROUND

1. Technical Field

The present invention relates to a printing device including a stacker on which a printing medium which is discharged from a printing device main body is placed.

2. Related Art

There are printing devices which include stackers on which printing media after being printed inside device main bodies are placed. For example, for a printing device disclosed in Japanese Laid Open Patent Publication No. 2004-338873, a stacker is arranged to project from an inside to an outside of a device main body automatically. For the printing device, it is possible to adjust automatically an amount of projecting out of the stacker from the device main body.

Then, for the printing device, when printing is requested, and when the amount of projecting out of the stacker is more than an amount of projecting out corresponding to a size of a printing medium being a printing target, the printing is performed on the printing medium, and the printing medium on which printing is performed is discharged to outside the device main body and is placed on the stacker. On the other hand, the amount of projecting out is less than the amount of projecting out corresponding to the size of the printing medium being the printing target, the printing to the printing medium is ceased.

Of the printing devices which are capable of projecting out the stackers from the inside to the outside the device main bodies automatically, there is one which leaves an operation of housing a stacker inside the device main boy on a manual operation of a user.

SUMMARY

The objective of the present invention is providing a printing device which enhances usability.

In order to attain the objective which is mentioned above, the printing device includes a printing mechanism configured to perform printing against a printing medium fed to a printing area inside a device main body, a stacker configured to receive the printing medium discharged from the printing area, a drive device configured to cause a state of the stacker to be a housed state in which the stacker is housed inside the device main body and a projecting state in which the stacker projects outside the device main body, and a control device configured to change the state of the stacker from the housed state to the projecting state by controlling the drive device. And the control device is configured to perform an automatic housing process to change the state of the stacker to the housed state by controlling the drive device, in a case in which the housing condition, when the state of the stacker is the projecting state, is established for the stacker to be housed inside the device main body.

According to the above mentioned configuration, when the stacker projects outside the device main body, and when the housing condition is established in a state in which the printing medium which has been discharged from the printing area is configurable on the stacker, the stacker is automatically housed in the device main body. In other words, the user can omit time and effort for manually housing the stacker inside the device main body. Therefore, the usability is enhanced.

For the above mentioned printing device, it is preferable that the housing condition includes a condition in which a power-off request for the printing device is conducted. According to the configuration, it is possible to house automatically the stacker inside the device main body under a condition in which the request to turn off the printing device is conducted by the user. For this reason, while it is possible to omit the time and the effort to house manually the stacker inside the device main body, burden of the user, when the power of the printing device is off, is decreased.

The above mentioned printing device includes a cassette configured to contain the printing medium before printing, and a feeding mechanism configured to feed the medium in the cassette to the printing area, wherein it is fine that the cassette is detachable beneath the stacker in the device main body. In the case, the housing condition preferably includes a condition that has a probability in which the cassette is detached from the device main body.

If the stacker projects out of the device main body when the cassette is to be detached from the device main body, the stacker hampers the user and thus it is difficult for the user to detach the cassette from the device main body. On this regard, with the above mentioned configuration, when there is possibility that the cassette is detached from the device main body, it is possible that the stacker is automatically housed inside the device main body. In this way, when the stacker is automatically housed inside the device main body, the user can easily detach the cassette from the device main body.

Also, it is preferable for the above mentioned printing device that the housing condition includes a condition in which the cassette contains no printing medium when the request for printing is conducted.

The case in which it is possible for the cassette to be detached from the device main body can be a case in which there is no printing medium when the request for printing is conducted. In the above mentioned configuration, when there is no printing medium in the cassette in case in which printing is requested, the stacker is automatically housed inside the device main body because it is possible to determine that the user detaches the cassette from the device main body. For this reason, since the time and the effort of housing inside the device main body manually can be omitted, in case in which the printing medium is restocked by detaching the cassette from the device main body, it is possible that the usability is enhanced.

Also, for the above mentioned printing device, it is preferable that the housing condition includes a condition in which a size of the printing medium requested for printing is different from to size of the printing medium in the cassette. The case in which it is possible that the cassette is detached from the device main body can be a case in which the size of the printing medium requested for printing is different from the size of the printing medium in the cassette. In the above mentioned configuration, when the size of the printing medium requested for printing is different from the size of the printing medium in the cassette, the user can determine that it is possible for the cassette to be detached from the device main body, and thus the stacker is automatically housed inside the device main body. For this reason, in case in which the kind of the printing medium in the cassette is changed by detaching from the device main body, the time and the effort of manually housing the stacker inside the device main body is omitted, and thus the usability is enhanced.

For the above mentioned printing device, the stacker includes a guide part configured to guide a tray configured to hold the medium to the printing area, the printing mechanism performs printing on the medium which has been guided to the printing area and held in the tray, and it is preferable that the housing condition includes a condition in which printing on the medium which has been held on the tray is requested.

In case in which the stacker including the guide part projects outside the device main body, the guide part is apart from the printing area, and it is difficult for the guide part to guide the tray to the printing area. For this reason, it is possible to guide by the guide part of the stacker the tray to the printing area properly by housing the stacker inside the device main body, when printing on the medium set in the tray. In the above mentioned configuration, when printing to the medium sent in the tray is requested, the stacker is automatically housed inside the device main body. Therefore, because the time and the effort of manually housing the stacker inside the device main body when printing on the medium set in the tray can be omitted, the usability can be enhanced.

Also, the above mentioned printing device includes an operation device rotatably supported by the device main body and including an operation part, and a rotation adjusting part configured to adjust a rotation position of the operation device. It is fine that a rotation trajectory of the operation device overlaps a moving pathway of the stacker. In this case, when the power-off request of the printing device is requested in the state where the operation device is arranged on the moving pathway of the stacker, the control device is configured to preferably rotate the operation device outside the moving pathway of the stacker by controlling the rotation adjusting part to perform the automatic housing.

Under the condition in which turning off the power of the printing device is requested, when housing the stacker inside the device main body, the stacker being housed automatically inside the device main body interferers with the operation device in case in which the stacker is on the moving pathway of the operation device. On this point, in the above mentioned configuration, under the condition in which turning off the power of the printing device is requested, when the stacker is housed inside the device main body, the stacker is housed automatically inside the device main body in the state in which the operation device is arranged off the pathway of the stacker by the rotation adjusting part. Therefore, it is possible to avoid the interference of the stacker, which is housed automatically inside the device main body, and the operation device.

Also, the above mentioned printing device includes the operation device rotatably supported by the device main body and including the operation part, and the rotation adjusting part configured to adjust the rotation position of the operation device. It is fine that the rotation trajectory of the operation device overlaps the moving pathway of the stacker. In this case, when printing to the medium held on the tray is requested, it is preferable that the control device is configured to maintain the state of the operation device off the moving pathway of the stacker by controlling the rotation adjusting part, until the housing process and the printing process for printing on the medium held on the tray are finished.

When printing is finished in case in which printing is performed to the medium set in the tray, the tray is discharged outside the device main body as the tray is guided by the guide part provided on the stacker. At this time, when the operation device is on the moving pathway of the stacker, there is a chance in which the tray being discharged from the device main body interferes with the operation device. On this point, in the above mentioned configuration, the operation device keeps the state of the operation device to be off the moving pathway of the stacker, until the automatic housing process and printing to the medium set in the tray are finished. Thus, it is possible to avoid the interference of the tray discharged from the device main body after printing to the medium and the operation device.

BRIEF DESCRIPTION OF THE DRAWINGS

Referring now to the attached drawings which form a part of this original disclosure:

FIG. 9 is a flow chart describing a process routine which the control device performs when determining an implementing timing of housing the stacker automatically while the power of the printing device is on.

DETAILED DESCRIPTION OF EXEMPLARY EMBODIMENTS

Hereinafter, one embodiment which objectifies a printing device to a serial printer with an ink jet method is described by referring to FIGS. 1-9.

Figure 1:
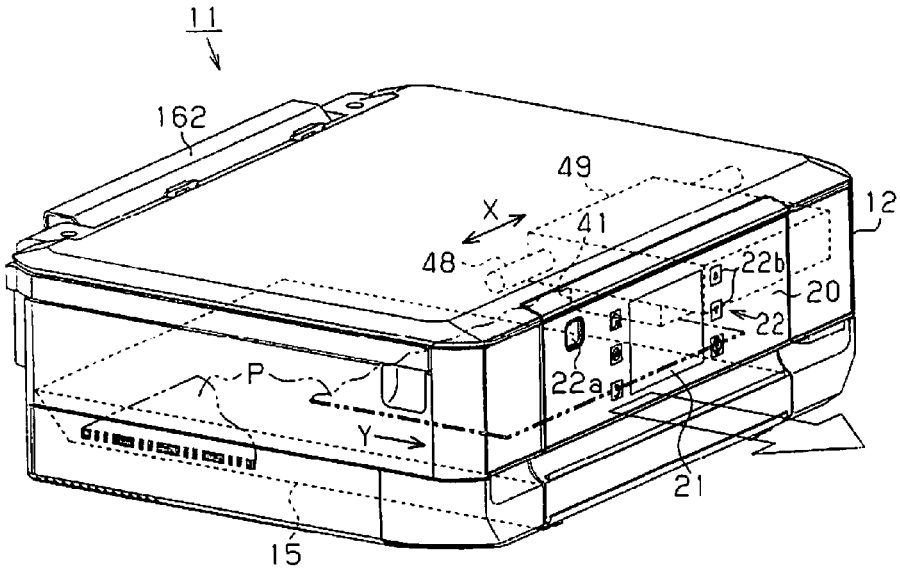
FIG. 1 is a schematic perspective view of an embodiment of the printing device.
Figure 2:
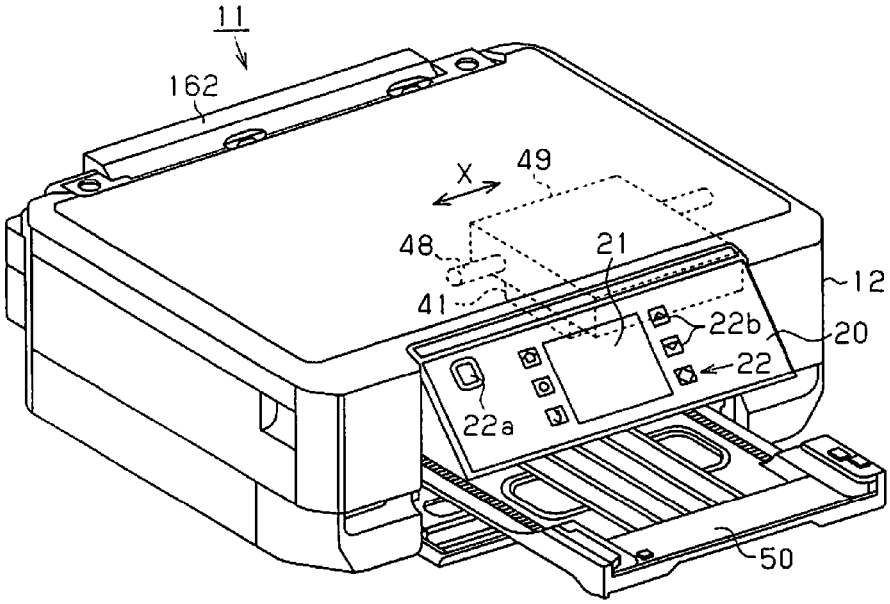
FIG. 2 is a schematic perspective view of the printing device with the stacker projecting out of the device main body.

As shown in FIGS. 1 and 2, a printing device 11 includes a device main body 12 which is slim type and which has substantially rectangular shape, and an operation device 20 provided on a front part (right part in FIG. 1) of the device main body 12. For the printing device 11 of the present embodiment, the operation device 20 has a panel shape, for example. An upper part of the operation device 20 is rotatably supported at the front part of the device main body 12 via a rotation axis, while the operation device 20 is rotatable such that a lower part thereof is forwardly moves. The operation device 20 includes a display part 21 composed of a liquid crystal panel or the like, and an operation part 22 composed of a plurality operation switches. The operation part 22 includes a power switch 22*a* to be operated for turning on and off power of the printing device 11, a selection switch 22*b* to be operated for selecting, on a displayed menu displayed on the display part 21, selection items desired, and the like.

At a bottom side position of the operation device 20 at the front part of the device main body 12, a cassette 15 which can contain a plurality of paper sheets P as an example of a printing medium is equipped as being in a detachable and attachable (insertable and extractable) state. The paper sheet P in the cassette 15 is discharged in a forward direction of the device main body 12 along a transferring direction Y, after being fed to a printing area located in an upper side of the cassette 15 in the device main body 12 and being printed.

The device main body 12 is provided in a state in which a stacker 50 which is formed of a single tray having a substantially rectangular shape is possible to come out and come in (departing and retracting) (however, in the projecting out state in FIG. 2). The stacker 50 is an electrical type and is movable between a housed position (a state indicated in FIG. 1) of being housed inside the device main body 12 and a projecting position (a state indicated in FIG. 2) of projecting out from the device main body 12 with a maximum amount (projecting amount). Then, the paper sheet P which has been printed is discharged on the stacker 50 in the projecting position. "Housed state" is a state in which the stacker 50 is located at the housed position, and "projecting state" is a state in which the stacker 50 is located at the projecting position.

Figure 3:
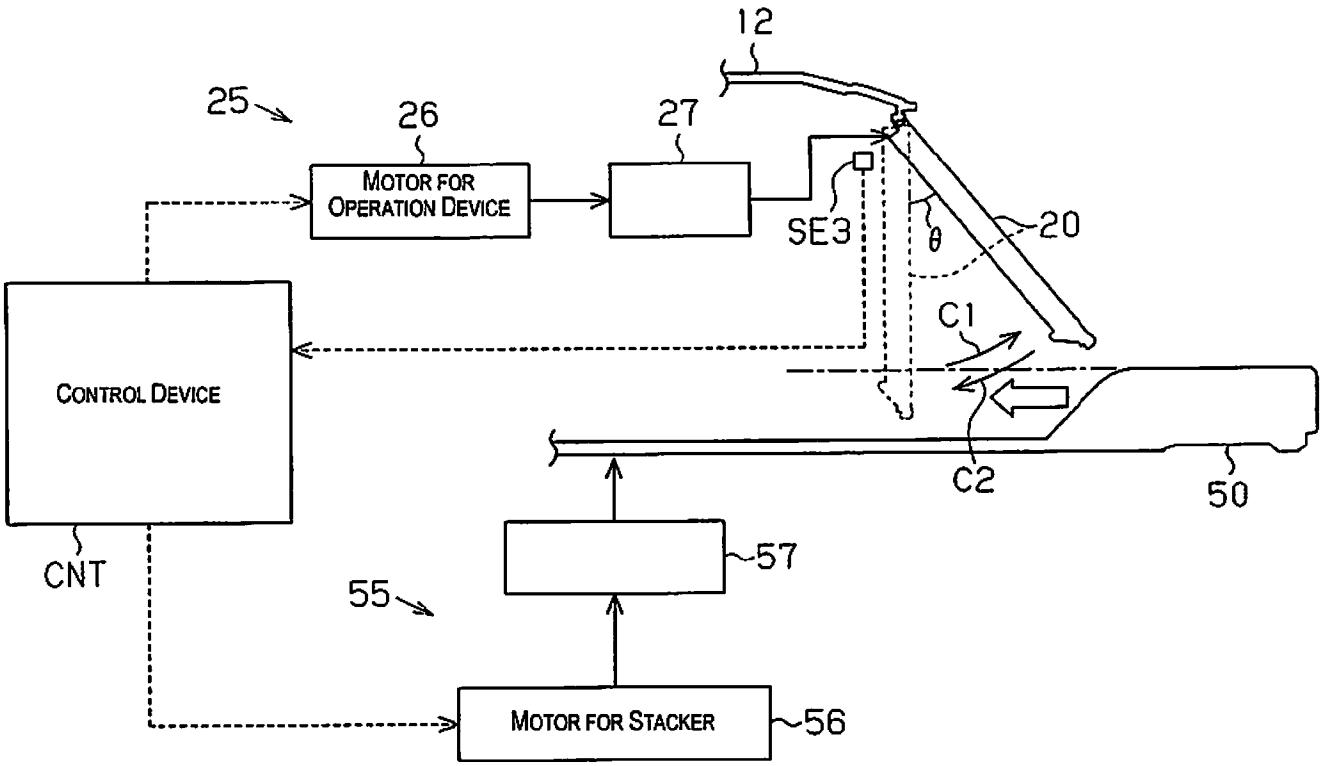
FIG. 3 is a pattern view showing relationship between the rotation trajectory of the operation device the moving pathway of the stacker.

As shown in FIG. 3, the printing device 11 of the present embodiment includes a rotation adjusting part 25 to rotate the operation device 20 and a stacker movement adjusting part 55 as an example of the drive device which moves the stacker 50. The rotation adjusting part 25 includes a motor 26 for the operation device as a drive source, and a deceleration mechanism 27 to decelerate drive power from the motor 26 for the operation device. The operation device 20 is rotated by transferring the drive power from the motor 26 for the operation device through the deceleration mechanism 27. Also, the rotation adjusting part 25 includes a rotation angle detection sensor SE3 which outputs a signal responding to a rotation angle θ of the operation device 20 from a reference position as shown in FIG. 3 with a broken line to a control device CNT. Here, a rotation direction of the operation device 20 which increases the rotation angle θ is called an open direction C1, while a rotation direction of the operation device 20 which decreases the rotation angle θ is called a close direction C2.

The stacker movement adjusting part 55 includes the motor 56 for the stacker as the drive source, and a deceleration mechanism 57 which decelerates the drive power from the motor 56 for the stacker. The stacker 50 moves between the housed position and the projecting position by transmitting the drive power from the motor 56 for the stacker through the deceleration mechanism 57.

A moving pathway of the stacker 50 which moves between the housed position and the projecting position overlaps a rotation trajectory of the operation device 20. In other words, when the operation device 20 is on the reference position which is shown in FIG. 3 with the broken line, the stacker 50 which moves between the housed position and the projecting position interferes with the operation device 20. For this reason, the stacker 50 is moved towards the projecting position after the operation device 20 is confirmed not being on the moving pathway of the stacker 50, when moving the stacker 50 from the housed position to the projecting position by for example turning on and off the power of the printing device 11. At this time, the stacker 50 is moved to the projecting position after the operation device 20 is rotated in the open direction C1, when the operation device 20 is on the moving pathway of the stacker 50.

Also, the stacker 50 is moved towards the housed position after the operation device 20 is confirmed not being on the moving pathway of the stacker 50, when moving the stacker 50 from the projecting position to the housed position by for example turning on and off the power of the printing device 11. At this time, the stacker 50 is moved towards the housed position after the operation device 20 is pulled in the open direction C1, when the operation device 20 is on the moving pathway of the stacker 50.

Figure 4:
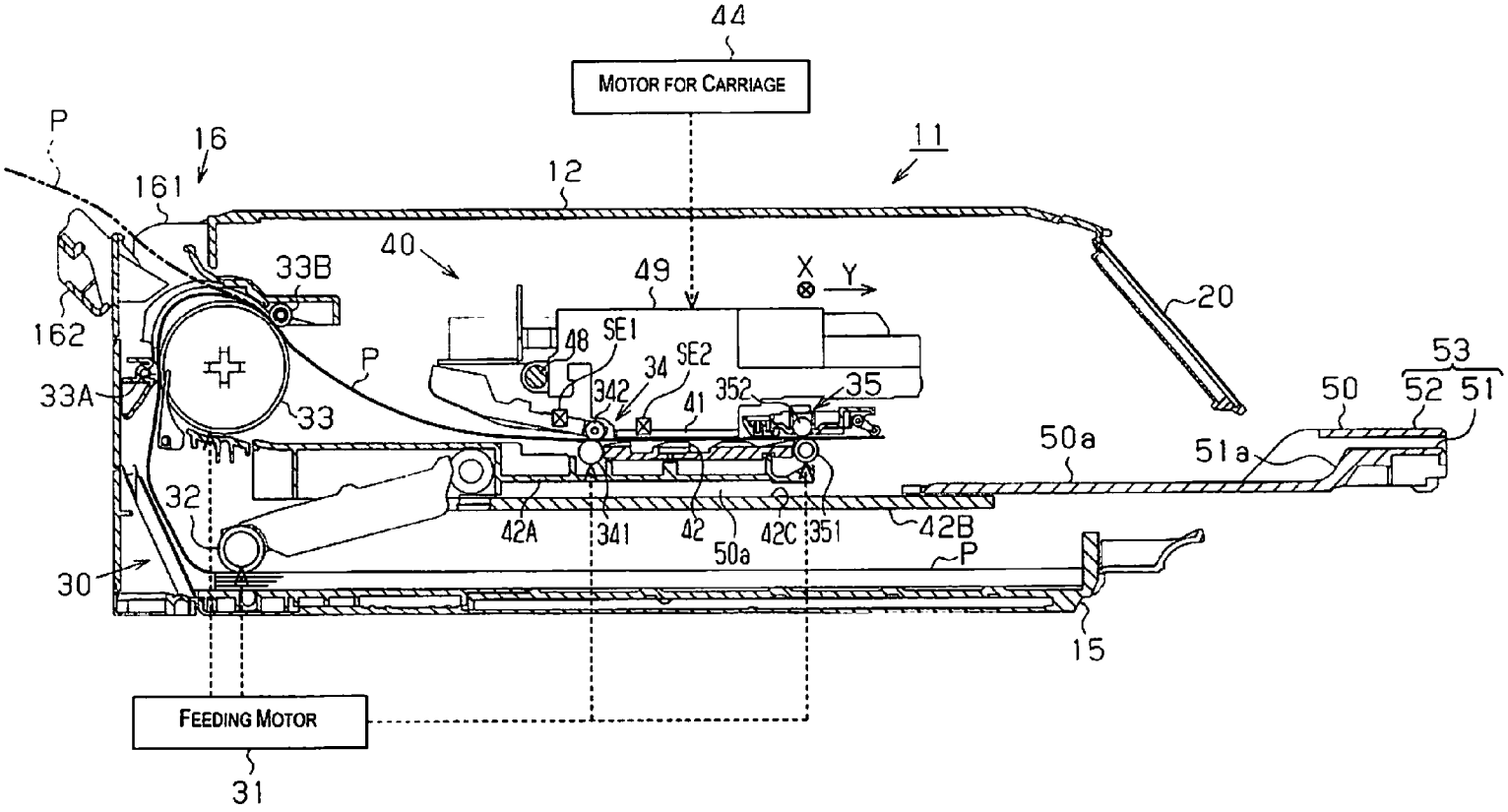
FIG. 4 is a sectional view of a schematic configuration of an inside of the printing device of the embodiment.

Also, as shown in FIG. 4, the printing device 11 includes a feeding mechanism 30 which transfers the paper sheet P, and a printing mechanism 40 which prints on the paper sheet P in the printing area.

The feeding mechanism 30 is a mechanism to function using a feeding motor 31 as the drive source. In other words, the feeding mechanism 30 includes a pickup roller 32 which sends the paper sheet P at the upper most part in the cassette 15 from the cassette 15 upwardly, and an intermediate roller 33 which is arranged above the pickup roller 32. By the way, printing on the paper sheet P of the cassette 15 is also called "cassette feed printing."

Also, separation roller 33A and a feeding driven roller 33B are provided adjacent to the intermediate roller 33. The separation roller 33A and the feeding driven roller 33B are driven and rotated on the basis of the rotation of the intermediate roller 33. The separation roller 33A holds the paper sheet P from the cassette 15 with the intermediate roller 33, and transfers the paper sheet P downwardly in a transferring pathway by the rotation of the intermediate roller 33. Also, the feeding driven roller 33B holds with the intermediate roller 33 the paper sheet P fed by the intermediate roller 33 and the separation roller 33A. And the feeding driven roller 33B transfers the paper sheet P towards the printing area by the rotation of the intermediate roller 33.

By the way, at a back part of the device main body 12, a manual feeding part 16 is provided to set the paper sheet P manually. The manual feeding part 16 includes a cover 162 which blocks an insert opening 161 being for the paper sheet P to be inserted to the device main body 12, where the cover 162 in a state of being rotatable is supported by the device main body 12. The cover 162 in a state of being open, as shown in FIG. 4, functions as "manual feeding tray" to hold the paper sheet P which is manually set. A tip of the paper sheet P which is set manually on the cover 162 is located at a setting position of the feeding driven roller 33B. Further, in this state, when the intermediate roller 33 is rotated, the paper sheet P set manually is held by the intermediate roller 33 and the feeding driven roller 33B, and fed to the printing area by the rotation of the intermediate roller 33 and the feeding driven roller 33B.

A pair of feeding rollers 34 is provided on the feeding pathway further downstream side than the intermediate roller 33, which means in the front side of the intermediate roller 33. The pair of feeding rollers 34 includes a feeding drive rotor 341 which is connected to and driven by the feeding motor 31, and a feeding driven roller 342 to be driven corresponding to the rotation of the feeding drive roller 341. Then, the pair of feeding rollers 34 holds the paper sheet P which has been fed by the rotation of the intermediate roller 33 in order to transfer to the printing area.

Also, a pair of discharging rollers 35 is provided in the front of the printing area. The pair of discharging rollers 35 includes an discharging driving roller 351 which is connected to and driven by the feeding motor 31, and an discharging driven roller 352 to be driven corresponding to the rotation of the discharging driving roller 351. Then, the pair of discharging rollers 35 holds the paper sheet P to discharge outside the device main body 12.

Also, at a detection position between the intermediate roller 33 and the pair of feeding rollers 34, a medium edge part detection sensor SE1 is provided to detect the paper sheet P passing through the detection position. For example, the detection position is right in the back of the pair of feeding rollers 34.

As indicated in FIGS. 1 and 4, the printing mechanism 40 includes a guide axis 48 which extends in a scanning direction X intersecting with a transferring direction Y, a carriage 49 which moves back and forth in the scanning direction X while being guided by the guide axis 48, and a support stand 42 which supports the paper sheet P which has been fed to the printing area. The carriage 49 is moved in the scanning direction X by transferring the drive power, via a transferring mechanism, of the motor 44 for the carriage as a drive source. A printing head 41 and a medium size detection sensor SE2 are provided at a lower part of the carriage 49. The printing head 41 performs printing on the paper sheet P which is supported by the support stand 42, by ejecting ink as an example of a printing material supplied from the ink cartridge. Also, the medium size detection sensor SE2 detects a width direction edge part of the paper sheet P which is supported by the support stand 42.

Figure 5:
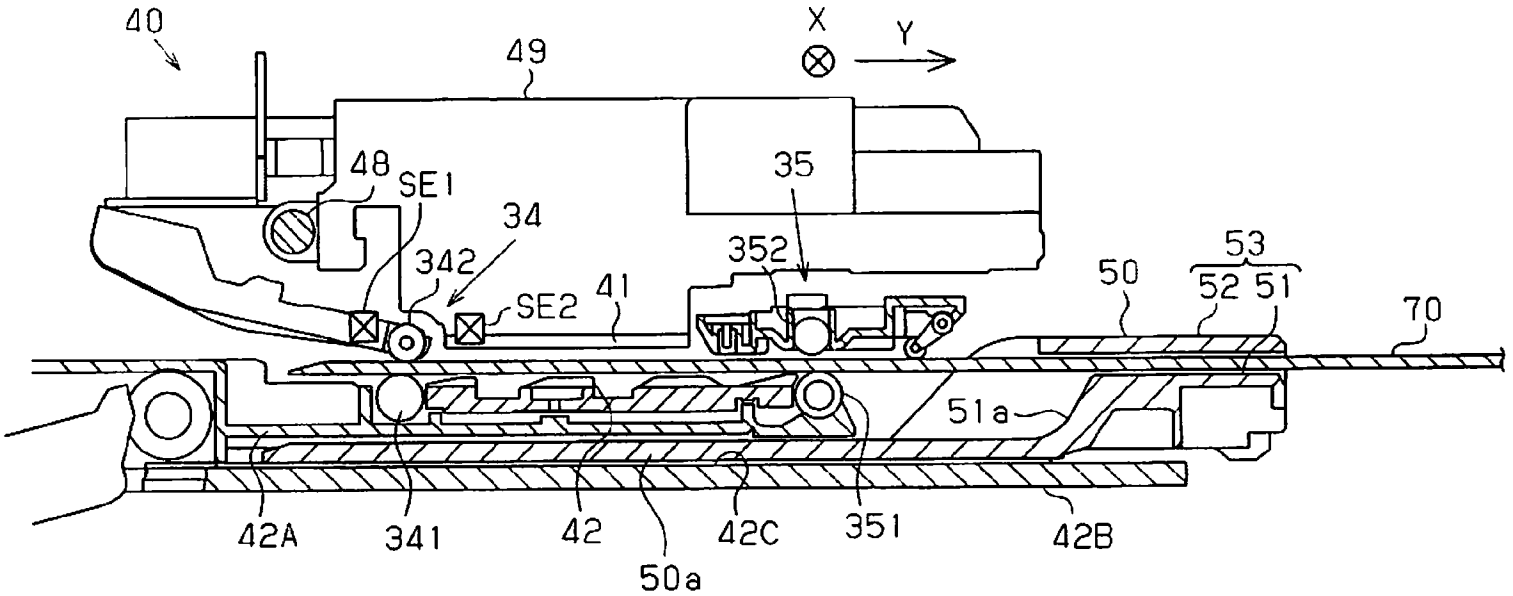
FIG. 5 is a sectional view showing a state in which the tray on which a disk is set is inserted in the printing area.

Next, a configuration of the stacker 50 is described by referring to FIGS. 2, 4, and 5.

As indicated in FIG. 2, a guide part 53 is provided in both sides in a width direction (same as the scanning direction X) of the stacker 50. The guide part 53 includes a stand part 51 bulging upwardly while forming an inclination guide surface 51*a* which inclines in order for an edge part in the transferring direction Y to be high as coming to a distal end side, and a bulgy part 52 which is provided further outside in the width direction than the stand part 51 and bulges higher than the stand part 51. Also, the stacker 50 includes, except a tip edge part, a substrate part 50*a* formed in a rectangular plate shape. Further, as indicated in FIG. 4, when the stacker 50 is housed inside the device main body 12, the substrate part 50*a* of the stacker 50 is located inside the guide part 42C between a plate frame 42A which is arranged in a lower side of the support stand 42 and a plate support part 42B which is arranged in a lower side of the frame 42A.

The printing device 11 of the present invention has a function of printing to the paper sheet P which is set manually or the paper sheet P in the cassette 15 as well as performing disk printing to print on disks such as CD-R, DVD-R, or the like.

As indicated in FIG. 5, a tray 70 on which a disk is placed is guided and inserted to the printing area inside the device main body 12 by the guide part 53 arranged on both sides in the width direction of the stacker 50.

In other words, the tray 70 in a state of being placed on both the stand parts 51 inside the pair of the bulgy parts 52 provided in the stacker 50 is inserted towards the printing area inside the device main body 12. At this time, displacement in the scanning direction X (in other words, the width direction of the stacker 50) of the tray 70 placed on both the stand parts 51 is limited by the pair of the bulgy parts 52.

Figure 6:
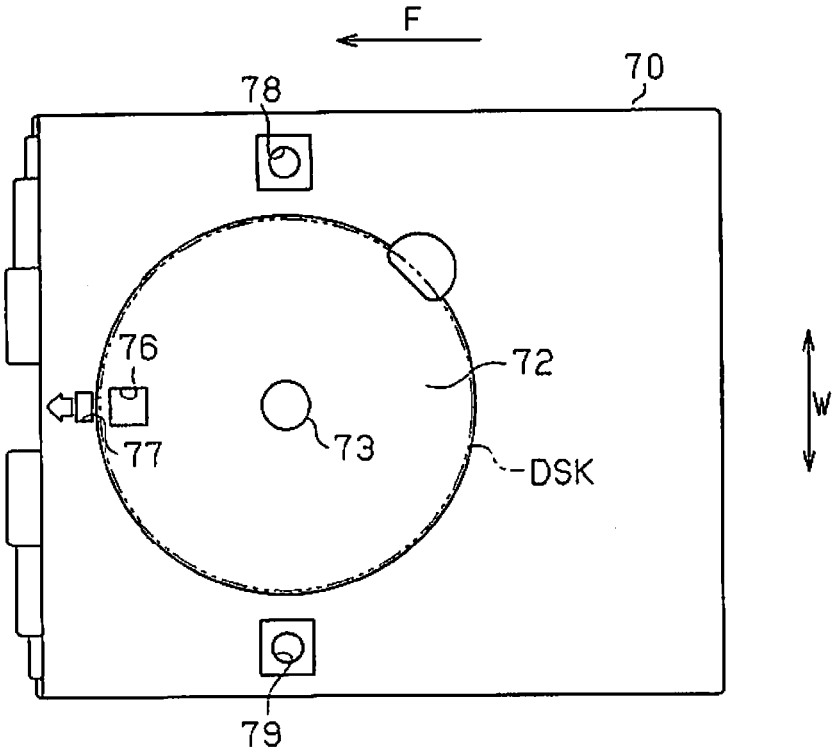
FIG. 6 is a flat surface view of a schematic configuration of the tray.

Next, a configuration the tray 70 is described by referring to FIG. 6.

As indicated in FIG. 6, the tray 70 is a plate material having a rectangular shape and arranged different from the printing device 11. A length in an insertion direction F of the tray 70 is longer than a length in a direction (width direction W) perpendicular to the insertion direction F. On an upper surface of the tray 70, a placement part 72 having a circle shape, on which a disk DSK is can be placed, is provided. In a center of this placement part 72, a holding part 73 is provided to hold a center of the disk DSK. Also, a disk detection hole 76 is provided to detect whether or not the disk DSK exists on the placement part 72.

A first detection hole 77 is provided in a center part in the width direction W of the tray 70 which is adjacent to an edge part on an insertion side of the tray 70 in order to detect details of the position of the tray 70. Also, on a line which extends in the width direction W of the tray 70 through the center of the holding part 73, a second detection hole 78 and a third detection hole 79 are provided to detect details of the position of the tray 70.

Figure 7:
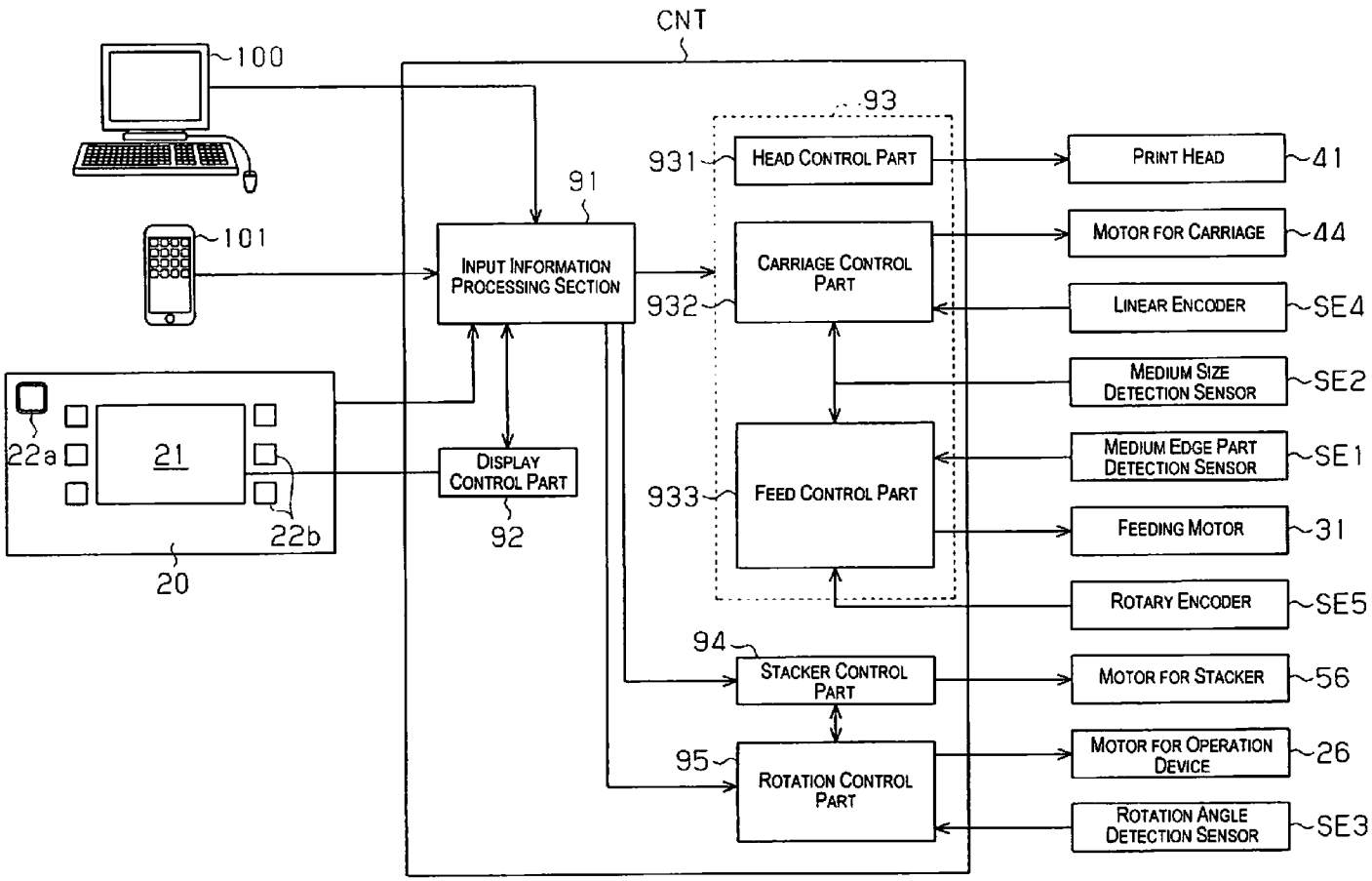
FIG. 7 is a block diagram showing an inside configuration of the control device of the printing device of the embodiment.

Next, a control device CNT of the printing device 11 is described by referring to FIG. 7.

As indicated in FIG. 7, the control device CNT is capable of transmitting and receiving information with external devices such as a mobile information terminal 101 and a personal computer 100. In other words, the control device CNT can print on the paper sheet P an image on the basis of image information received from the external device. Also, for example, the control device CNT performs a power off process for turning off the power of the printing device 11, when receiving the information of tuning off the power of the printing device 11 from the external device.

The control device CNT like this includes, as an example of a functional part to realize by at least one of a hardware and a software, a processing section 91, a display control part 92, a printing control part 93, a stacker control part 94, and a rotation control part 95.

An input information processing section 91 administrates processing of the information input from the operation device 20 or the information received from the above mentioned external device. For example, the input information processing section 91 outputs to the display control part 92 a signal instructing to change display contents on the display part 21 on the basis of the input information or the received information. Also, when receiving or inputting the image information to print, the input information processing section 91 outputs the image information to the printing control part 93. Also, when inputting or receiving the information corresponding to user's operation for turning on and off the power of the printing device 11, the input information processing section 91 outputs to the stacker control part 94 and the rotation control part 95 a signal regarding that.

The display control part 92 administrates controlling the display contents on the display part 21 of the operation device 20. In other words, the display control part 92 decides the display content on the display part 21 on the basis of the input information from the input information processing section 91. For example, when information regarding intension of determining the size of the paper sheet as the print target is input from the input information processing section, the display control part 92 display on the display part 21 an image showing the size of the paper sheet which is selectable.

The printing control part 93 includes a head control part 931, a carriage control part 932, and a feed control part 933. The head control part 931 administrates controlling the printing head 41. For example, the head control part 931 determines an ejection timing of the ink from the printing head 41 when printing.

The carriage control part 932 administrates moving amount, moving velocity, and a moving direction of the carriage 49. For example, the carriage control part 932 detects the moving amount in the scanning direction X, the moving velocity, and the moving direction on the basis of the output signal from a linear encoder SE4. Also, the output signal from the medium size detection sensor SE2 provided in the carriage 49 is input to the carriage control part 932. And the carriage control part 932 detects the size of the paper sheet P (more specifically the width of the paper sheet P) held by the support stand 42 by monitoring the output signal from the linear encoder SE4 and the medium size detection sensor SE2, while moving the carriage 49 back and forth in the scanning direction X. When a size of the paper sheet P being detected is different from the size of the paper sheet requested for printing, the carriage control part 932 outputs to the input information processing section 91 the signal regarding that.

The feed control part 933 administrates controlling the feeding mechanism 30. The output signal from a rotary encoder SE5 which outputs the signal corresponding to the rotation velocity of the output axis of the motor 31 is input the feed control part 933 like this. Then, the feed control part 933 controls the drive of the feeding motor 31 on the basis of the output signal from each of the sensors SE1, SE2, and SE5. For example, when the paper sheet P is not detected by the medium edge part detection sensor SE1 although the feeding motor 31 is driven for initiating printing, the feed control part 933 outputs the signal regarding that to the input information processing section 91.

The stacker control part 94 administrates controlling the position of the stacker 50. For example, when the stacker 50 is moved from the housed position to the projecting position, the stacker control part 94 rotates the motor 56 for the stacker in a forward direction. On the other hand, when the stacker 50 is moved from the projecting position to the housed position, the stacker control part 94 rotates the motor 56 for the stacker in a reverse direction. Also, when the stacker 50 is moved, the stacker control part 94 outputs a signal requesting permission to start moving the stacker 50 to the rotation control part 95 before starting driving the motor 56 for the stacker. Then, when a signal of permitting to start moving the stacker 50, as a reply, from the rotation control part 95, the stacker control part 94 starts driving the motor 56 for the stacker.

The rotation control part 95 administrates the rotation angle θ of the operation device 20. For example, when the signal requesting the permission to start moving the stacker 50 is input from the stacker control part 94, the rotation control part 95 detects the rotation angle θ of the operation device 20 on the basis of the signal from the rotation angle detection sensor SE3 and determines whether or not the rotation angle θ is larger than an open determination angle θTh. The open determination angle θTh is a value which is set as a determination reference to see whether or not the stacker 50 on the move can avoid interfering with the operation device 20. Then, when the rotation angle θ is equal to the open determination angle θTh, the interference of the stacker 50 with the operation device 20 can be avoided.

When the rotation angle θ is smaller than the open determination angle θTh, the rotation control part 95 drives the motor 26 for the operation device in order to rotate the operation device 20 in the open direction C1. Then, when the rotation angle θ is larger than the open determination angle θTh, the rotation control part 95 outputs a signal of permitting to start moving the stacker 50 to the stacker control part 94.

Figure 8:
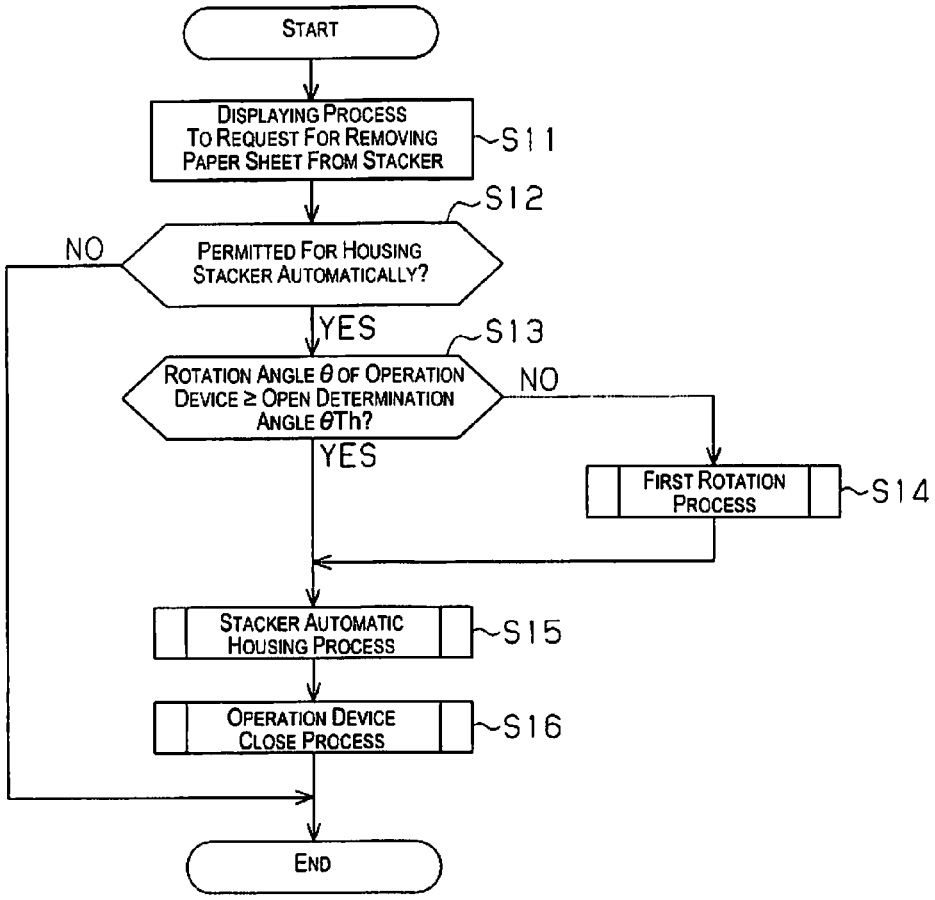
FIG. 8 is a flow chart describing a process routine which the control device performs when turning off the power of the printing device is requested.

Next, when inputting or receiving the information regarding turning off the power of the printing device 11 is performed, a process routine which the control device CNT implements is described by referring to the flowchart of FIG. 8.

As indicated in FIG. 8, in the process routine, the control device CNT performs a display process (step S11) to display a message regarding a request for removing the paper sheet P on the stacker 50.

The message includes a message regarding that the user decides whether or not the stacker 50 is housed automatically.

Here, when the request of turning off the power of the printing device 11 is a request based on user's input by operating the operation device 20, the control device CNT makes the display part 21 of the operation device 20 display the above mentioned message. When the request of turning off the power of the printing device 11 by the user by operating the external device such as the personal computer 100, the mobile information terminal 101, or the like, the control device CNT transmits to the external device the information to display the above mentioned message on a display of the external device.

Next, the control device CNT determines (step S12) whether or not the user permits the stacker 50 to be housed automatically, by implementing the display process in step S11. In the step S12, when the information regarding permitting the stacker 50 to be housed automatically is received or input, it is determined that the stacker 50 is permitted to be housed automatically, but when the information regarding not permitting the stacker 50 to be housed automatically is received or input, it is determined that the stacker 50 is not permitted to be housed automatically.

Then, when the user does not permit (step S12: NO) the stacker 50 to be housed automatically regarding turning off the printing device 11, the control device CNT ends the process routine. After that, the control device CNT implements turning off the power of the printing device 11, while the stacker 50 remains in a state of being in the projecting position.

On the other hand, when the user permits (step S12: YES) the stacker 50 to be housed automatically regarding turning off the printing device 11, the control determines (step S13) whether or not the rotation angle θ of the operation device 20 which is detected by the rotation angle detection sensor SE3 is larger than the above mentioned open determination angle θTh. When the rotation angle θ is smaller than the open determination angle θTh (step S13: NO), the control device CNT performs a first rotation process (step S14) to drive the motor 26 for an operation device to make the rotation angle to be the open determination angle θTh. Then, the control device CNT proceeds its process to step S15. On the other hand, when the rotation angle θ is larger than the open determination angle θTh (step S13: YES), the control device CNT proceeds its process to step S15, not performing step S14.

In step S15, the control device CNT performs the stacker automatic housing for automatically housing the stacker 50 to the housing position. In other words, when a drive amount corresponding to the moving amount in moving from the projecting position to the housing position is defined as a first drive amount, the control device CNT drives the motor 56 for the stacker for a second drive amount slightly larger than the first drive amount. Thus, for the printing device 11 of the present embodiment, the request of turning off the power of the printing device 11 is one example of "the housing condition for housing the stacker 50 inside the device main body 12."

Next, the control device CNT performs a close process (step S16) of the operation device 20 to rotate the operation device 20 to the above mentioned reference position in a close direction C2. In other words, the control device CNT drives the motor 26 for the operation device in order to make the rotation angle θ which is detected by the rotation angle detection sensor SE3 to be "0 (zero)." After that, the control device CNT implements turning off the power of the printing device 11 after finishing the process routine.

Figure 9:
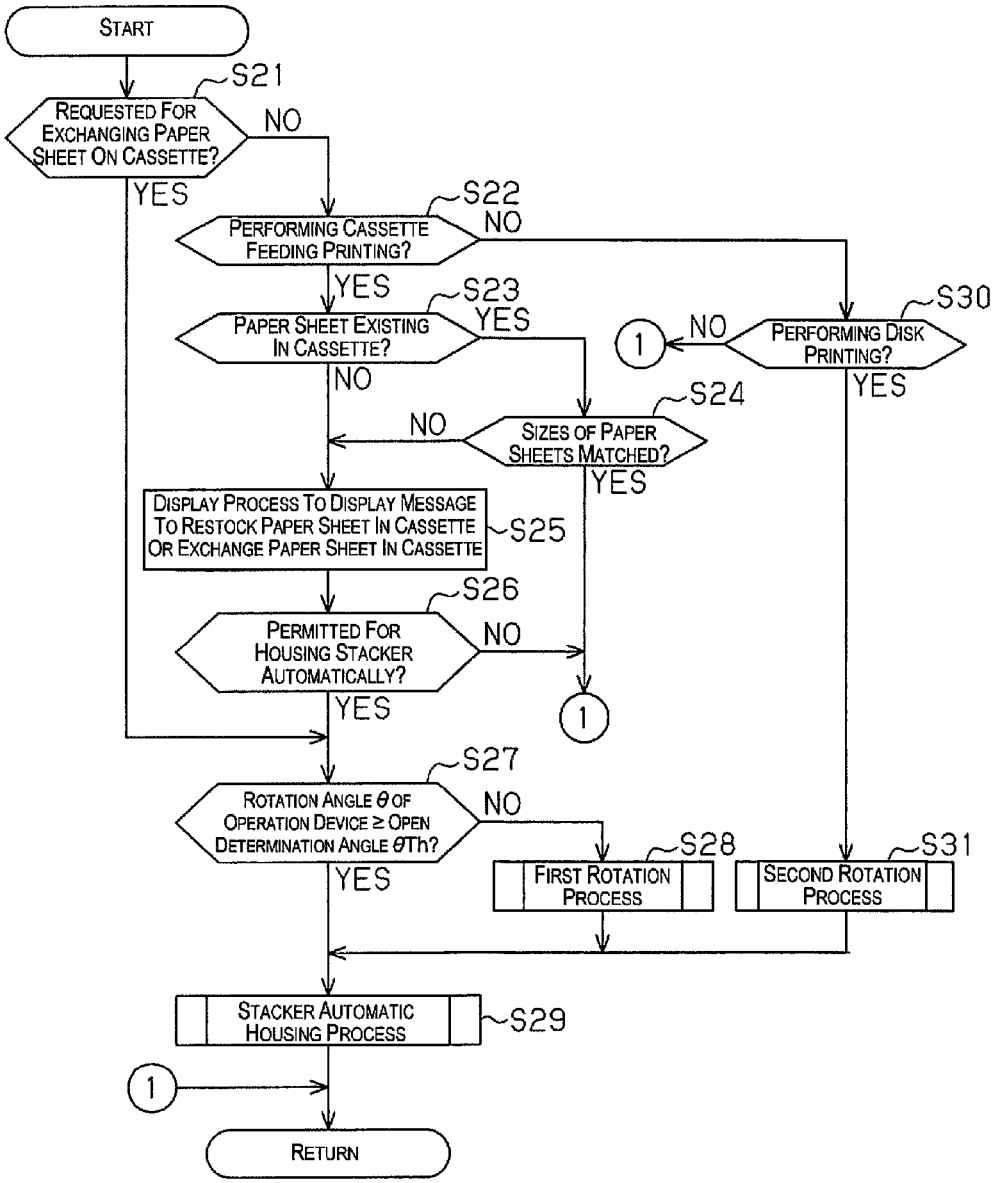

Next, a process routine which the control device CNT implements when a timing for the stacker automatic housing to be implemented is determined in case in which the power of the printing device 11 is on, is described by referring to the flowchart indicated in FIG. 9. By the way, the process routine is a process routine implemented in each control cycle which is previous set when the power of the printing device 11 is on.

As indicated in FIG. 9, in the process routine, the control device CNT determines (step S21) whether or not exchanging the paper sheet P inside the cassette 15 is requested by an input operation by the user. The cassette 15 is positioned in the lower side of the stacker 50. For that reason, when exchanging the paper sheet P in the cassette 15, if the stacker 50 is arranged in the projecting position, the user has difficulty in detaching the cassette 15 from the device main body 12 because the stacker 50 interferes. When exchanging the paper sheet P in the cassette 15 is requested, it is preferable to perform the stacker automatic housing process in view of the possibility that the cassette 15 is detached by the user from the device main body 12. In other words, for the printing device 11 of the present embodiment, the request of exchanging the paper sheet in the stacker 50 is one example of "the housing condition for housing the stacker 50 inside the device main body 12."

For this reason, when exchanging the paper sheet P in the cassette 15 is requested (step S21: YES), the control device CNT proceeds its process to step S27 which is described hereinafter. On the other hand, when exchanging the paper sheet P in the cassette 15 is not requested (step S21: NO), the control device CNT determines whether or not the cassette feed printing is performed (step S22). When the cassette feed printing is not performed (step S22: NO), the control device CNT proceeds its process to step S30.

On the other hand, when the cassette feed printing is performed (step S22: YES), the control device CNT determines whether or not there is the paper sheet P in the cassette 15 (step S23). When there is no paper sheet P in the cassette 15, the user detaches the cassette 15 from the device main body 12, and attaches the cassette 15 to the device main body 12 after restocking the paper sheet P in the cassette 15. At this time, if the stacker 50 is arranged in the projecting position, the user has difficulty in detaching the cassette 15 from the device main body 12 because the stacker 50 interferes. When there is no paper sheet P in the cassette 15, it is possible that the user detaches the cassette 15 from the device main body 12, and it is preferable to perform the stacker automatic housing process. In other words, for the printing device 11 of the present embodiment, a fact that there is no paper sheet in the cassette 15 in the cassette feed printing is one example of "the housing condition of housing the stacker 50 inside the device main body 12."

Here, one example of determining whether or not there is the paper sheet P in the cassette 15 is described. In other words, when performing the cassette feed printing, the control device CNT drives the feeding mechanism 30 on the premise for the paper sheet P exists in the cassette 15. When the paper sheet P is in the cassette 15 and prescribed time elapses after starting transferring the paper sheet P from the cassette 15 by the feeding mechanism 30, the paper sheet P reaches the detection position on the feeding pathway and is detected by the medium edge part detection sensor SE1. On the other hand, even though the prescribed time elapses after starting driving the feeding mechanism 30 in case in which there is no paper sheet P in the cassette 15, the paper sheet P cannot be detected by the medium edge part detection sensor SE1. In case in which the paper sheet P cannot be detected by the medium edge part detection sensor SE1 even though the prescribed time elapses after starting driving the feeding mechanism, it can be determined that there is no paper sheet P in the cassette 15.

Then, when there is no paper sheet P in the cassette 15 (step S23: NO), the control device CNT proceeds its process to step S25. On the other hand, when the paper sheet P exists in the cassette 15 (step S23: NO), the control device CNT proceeds its process to step S24.

In step S24, the control device CNT determines whether or not the size of the paper sheet requested by the user for printing matches with the size of the paper sheet fed from the cassette 15. When the size of the paper sheet requested for printing does not match the size of the paper sheet fed from the cassette 15, the user detaches the cassette 15 from the device main body 12, and equips the cassette 15 to the device main body 12 after restocking paper sheet P with the desired size in the cassette 15. At this time, when the stacker 50 is at the projecting position, it is difficult for the user to detach the cassette 15 from the device main body 12 because the stacker 50 interferes. Therefore, when the size of the paper sheet requested for printing does not match the size of the paper sheet fed from the cassette 15, there is a chance that the user detaches the cassette 15 from the device main body 12 and it is preferable to perform the stacker automatic housing process. For the printing device 11 of the present embodiment, a fact that the size of the paper sheet requested for printing does not match the size of the paper sheet fed from the cassette 15 is one example of "the housing condition of housing the stacker 50 inside the device main body 12."

Here, one example of a determining method for determining whether or not the size of the paper sheet requested by the user for printing matches the size of the paper sheet fed from the cassette 15 is described. In other words, when performing the cassette feed printing, the control device CNT feeds the paper sheet P in the cassette 15 to the printing area by the function of the feeding mechanism 30. And the control device CNT moves the carriage 49 in the scanning direction X, while the paper sheet P is in a state of being held by the support stand 42. At this time, the control device CNT positions of both ends in the width direction of the paper sheet P and length of the paper sheet P in the width direction, on the basis of the signal from the medium size detection sensor SE2 and the linear encoder SE4, namely estimating the size of the paper sheet P. When the size of the paper sheet input in printing does not match the size of the paper sheet P estimated, the control device CNT determines that the size of the paper sheet requested by the user for printing does not match the size of the paper sheet fed from the cassette 15.

When the size of the paper sheet requested by the user for printing does not match the size of the paper sheet fed from the cassette 15 (step S24: NO), the control device CNT proceeds its process to step S25. On the other hand, when the size of the paper sheet requested by the user for printing matches the size of the paper sheet fed from the cassette 15 (step S24: YES), the control device CNT finishes the process routine once.

In step S25, the control device CNT performs the display process to display a message to restock the paper sheet in the cassette 15 or exchange the paper sheet in the cassette 15. In other words, when there is no paper sheet in the cassette 15, a message for the user to select one of restocking the paper sheet in the cassette 15 and canceling the print processing is displayed. Also, when the size of the paper sheet does not match, a message for the user to select one of exchanging the paper sheet in the cassette 15, keeping the print processing, and canceling the print processing is displayed.

Here, when the request for implementing the cassette feed printing is a request based on the input operation of the operation device 20 by the user, the control device CNT makes the display part 21 of the operation device 20 display the above mentioned message. Also, when implementing the cassette feed printing is requested by the operation of the user via the external device such as the personal computer 100 and the mobile information terminal 101, the control device CNT transmits to the external device the information regarding displaying the above mentioned message on the display of the external device.

Next, the control device CNT determines whether or not the automatic housing of the stacker 50 is permitted by the user (step S26). Here, when exchanging the paper sheet in the cassette 15 or restocking the paper sheet in the cassette 15 is selected by the user, it is determined that the automatic housing of the stacker 50 is permitted. When the automatic housing of the stacker 50 is permitted (step S26: YES), the control device CNT proceeds its process to step S27. On the other hand, when the automatic housing of the stacker 50 is not permitted (step S26: NO), the control device CNT finishes the process routine once.

In step S27, the control device CNT determines whether or not the operation angle θ of the operation device 20 detected by the rotation angle detection sensor SE3 is larger than the above mentioned open determination angle θTh. When the rotation angle θ is smaller than the open determination angle θTh (step S27: NO), the control device CNT performs the first rotation process (step S28), as in the above mentioned step S14. Then, the control device CNT proceeds its process to step S29. On the other hand, when the rotation angle θ is larger than the open determination angle θTh (step S27: YES), the control device CNT proceeds its process to step S29, not performing step 28.

In step S29, the control device CNT performs the stacker automatic housing, as in step S15. After that, the control device CNT finishes the process routine once.

In step S30, the control device CNT determines whether or not printing on the above mentioned disk is performed. When performing the disk printing, the disk DSK is placed on the tray 70 and the tray 70 is inserted until the printing area from the front part of the device main body 12. At this time, depending on the position of the operation device 20, there may be a chance that the operation device 20 interferes when the stacker 50 is moved to the housed position or when the tray 70 is inserted to the device main body 12. For this reason, when performing the disk printing, it is preferable to make the rotation angle θ of the operation device 20 larger than the open determination angle θTh (for example, in the configuration, the largest angle). In other words, for the printing device 11 of the present embodiment, requesting the disk printing is one example of "the housing condition for housing the stacker 50 inside the device main body 12."

Then, when not performing the disk printing (step S30: NO), the control device CNT finished the process routine once. On the other hand, when performing the disk printing (step S30: YES), the control device CNT performs the second rotation process to drive the motor 26 for the operation device in order to make the rotation angle θ larger than the open determination angle θTh (step S31). Then, the control device CNT proceeds its process to step S29 which was described before.

Next, a function of the printing device 11 is described, primarily regarding the automatic housing of the stacker 50 and an automatic adjustment of the rotation θ of the operation device 20.

When the power of the printing device 11 is turned on, the operation device 20 is rotated from the reference position and the stacker 50 is moved automatically from the housed position to the projecting position. When, in this state, the cassette feed printing is requested, the feeding mechanism 30 functions to feed the paper sheet P from the cassette 15 to the printing area. At this time, when there is no paper sheet P in the cassette 15, or the size of the paper sheet P in the cassette 15 does not match the size of the paper sheet requested, the user can request restocking the paper sheet inside the cassette 15 and exchanging the paper sheet in the cassette 15.

Then, restocking the paper sheet in the cassette 15 or exchanging the paper sheet in the cassette 15 is requested, the stacker 50 is automatically moved from the projecting position to the housing position without adjusting the rotation angle θ of the operation device 20, in case in which the rotation angle θ of the operation device 20 is larger than the open determination angle θTh. On the other hand, when the rotation angle θ is smaller than the open determination angle θTh, the operation device 20 is automatically rotated (first rotation process) until the rotation angle θ becomes the open determination angle θTh. Then, the stacker 50 is moved automatically from the projecting position to the housing position without the operation device 20 interfering, by implementing the stacker automatic housing process after the first rotation process.

Also, there may be a case where the user requests the cassette 15 to be detached from the device main body 12, regardless of the cassette feed printing. Even in this case, when the operation angle θ of the operation device 20 is smaller than the open determination angle θTh, the stacker 50 is moved automatically from the projecting position to the housed position, after the operation device 20 is rotated until the rotation angle θ becomes the open determination angle θTh by the first rotation process.

Also, when the user requests the disk printing, the stacker 50 is necessarily arranged in the housed position. For this reason, when the disk printing is requested, the operation device 20 is rotated until the rotation angle θ becomes the open determination angle θTh by the second rotation process. Then, the stacker is moved automatically from the projecting position to the housing position without the stacker 50 interfering with operation device 20 by implementing the stacker automatic housing process after the second rotation process ends.

When turning off the power of the printing device 11 is requested, when the stacker 50 is permitted to be housed automatically, and when the operation angle θ of the operation device 20 is smaller than the open determination angle θTh, the first rotation process is implemented. Then, when the operation device 20 is rotated until the rotation angle θ becomes the open determination angle θTh, the stacker 50 is moved automatically from the projecting position to the housed position by the stacker automatic housing process. After that, the operation device 20 is rotated by the close process of the operation device 20 until its rotation angle become "0 (zero)." In other words, the operation device 20 is rotated to the reference position. After that, the power of the printing device 11 is turned off by implementing the process in the power off.

With above mentioned configuration and the function, advantages below can be attained.

(1) The stacker 50 is housed automatically inside the device main body 12, when the housing condition is established in the state in which the stacker is arranged in the projecting position. In other words, it is possible to omit the time and the effort in housing the stacker 50 in the device main body 12 manually, and to enhance the usability.

(2) For example, when turning off the power of the printing device 11 is requested by the user, the stacker 50 is housed in the device main body 12. Therefore, it is possible to omit the time and the effort of the user in housing manually the stacker 50 in the device main body 12, when the power of the printing device 11 is off.

(3) Also, when the user requests detaching the cassette 15 from the device main body 12, or when there is a chance that the cassette 15 is requested to be detached from the device main body 12, the stacker 50 is housed automatically in the device main body 12.

In other words, the user can omit the time and the effort in housing manually the stacker 50 in the device main body 12, when the cassette 15 is detached from the device main body 12. As mentioned here, "when there is a chance that the cassette 15 is requested to be detached from the device main body 12" can be when there is no paper sheet P in the cassette 15 in case in which the cassette feed printing is requested, or when the size of the paper sheet requested is different from the size of the paper sheet in the cassette 15.

(4) Also, when the disk printing is requested, the stacker 50 is housed automatically in the device main body 12. Thus, when performing the disk printing, it is possible to omit the time and the effort in housing the stacker 50 manually in the device main body 12.

(5) Also, for the printing device 11 of the present embodiment, when the housing condition is established, the stacker 50 is housed automatically in the device main body 12 under the condition in which the rotation angle θ of the operation device 20 is larger than the open determination angle θTh. Thus, when housing the stacker 50 automatically in the device main body 12, it is possible to avoid the stacker 50 interfering with the operation device 20.

(6) Particularly, when performing the disk printing, the tray 70 on which the disk DSK is set is inserted towards to the printing area from the front part of the device main body 12. Thus, when the operation device 20 is arranged adjacent to the stacker 50 being in the housing position, the tray 70 is difficult to be inserted to the device main body 12 because the operation device 20 interferes. On this point, for the printing device 11 of the present embodiment, when performing the disk printing, the operation device 20 is apart from the stacker 50 with a greater distance. Thus, it is possible to enhance ease of inserting the tray 70 in the device main body 12.

(7) On the other hand, when the housing condition other than requesting the disk printing in the state in which the operation angle θ of the operation device 20 is smaller than the operation determination angle θTh, the operation device 20 is rotated until the rotation angle θ becomes the open determination angle θTh. On the other hand, the amount of rotation of the operation device 20 is limited to the degree in which the stacker 50 being moved from the projecting position to the housing position does not interfere with the operation device 20. Thus, because it is possible to limit the amount of the rotation of the operation device 20, the stacker automatic housing process can be started early.

(8) For the printing device 11 of the present embodiment, when the housing condition is established, and when housing the stacker 50 to the device main body 12 is permitted, the stacker 50 is housed automatically the device main body 12. At this time, under the condition in which the paper sheet P is confirmed not being placed on the stacker 50, it is possible permit automatically housing the stacker 50 in the device main body 12. Therefore, breakage of the paper sheet on the stacker 50 and being dropped of the printing device 11 can be prevented due to the automatic housing of the stacker 50 in the device main body 12.

Further, the above mentioned present embodiment can be modified as follows.

For the printing device 11, the rotation trajectory of the operation device 20 can be not overlapping with the moving pathway of the stacker 50. In this case, the operation device 20 does not interfere with the stacker 50, regardless of where the operation device 20 is arranged. For this reason, when the housing condition is established, and when the stacker 50 is moved from the projecting positon to the housed position, the position of the operation device 20 does not have to be adjusted. Also, for this configuration, it is fine to omit the rotation adjusting part 25 which automatically adjust the positon of the operation device 20. In this case, the rotation position of the operation device 20 is adjusted only manually.

In case in which the disk printing is requested, when the rotation angle θ of the operation device 20 is larger than the open determination angle θTh, the stacker 50 can be housed automatically in the device main body without adjusting the position of the operation device 20. Also, when the rotation angle θ is smaller than the open determination angle θTh, the stacker 50 can be housed automatically in the device main body 12 under the condition in which the rotation angle θ becomes the open determination angle θTh by rotating the operation device 20, namely by the first rotation process. With the configuration like this, an effect similar to the above mentioned (1) to (5) can be attained.

If it is possible to adjust separately the rotation of the operation device 20 and moving the stacker 50, it is fine to make the drive source of the rotation adjusting part 25 and the drive source of the stacker movement adjusting part 55 in common. In this case, it is fine selecting a control object in either the operation device 20 or the stacker 50 by configuring a drive transmission switching mechanism between the common drive source, and the stacker movement adjusting part 55 and the rotation adjusting part 25, and controlling the device transmission switching mechanism.

When a detection system which can detect the size of the paper sheet P in the cassette 15 is provided in the printing device 11, it is fine to determine whether or not the size of the paper sheet requested for printing matches the size of the paper sheet P in the cassette 15 on the basis of a detection result of the detection system. In this case, it is possible to determine whether or not there is a chance that the user requests detaching the cassette 15 from the device main body 12 before starting driving the feeding mechanism 30.

When the detection system which can detect whether or not the paper sheet P exists in the cassette 15 is provided in the printing device 11, it is fine to determine the paper sheet P is in the cassette 15 on the basis of the detection result by the detection system. In this case, it is possible to determine whether or not there is a chance that the user requests detaching the cassette 15 from the device main body 12 before starting driving the feeding mechanism 30.

When the stacker 50 projects from the device main body 12, the user may push the stacker 50 towards the device main body 12 in order to house the stacker 50 in the device main body 12.

Also, when the stacker 50 is housed in the device main body 12, the user may pull the stacker 50 in order for the stacker 50 to project out of the device main body 12. When the manual operation by the user is detected, it is fine to assist the manual operation of the user in housing the stacker 50 in the device main body 12, or sticking out the stacker 50 from the device main body 12, by driving the motor 56 for the stacker. However, when the power of the printing device 11 is off, and when the user performs the manual operation in housing the stacker 50 in the device main body 12 or sticking out the stacker 50 from the device main body 12, it is fine not to perform the assisting process which is mentioned above.

A method for detection the manual operation by the user in housing the stacker 50 in the device main body 12 and sticking out the stacker 50 from the device main body 12 can be considered, as follows. For example, when moving the stacker 50 by the above mentioned manual operation is started, and when its power is transmitted to the motor 56 for the stacker, the counter-electromotive force arises in the motor 56 for the stacker. When the counter-electromotive force is detected, it is possible to determine that the above mentioned manual operation is performed.

Also, when the manual operation is performed, there is a chance that the operation device 20 is on the moving pathway of the stacker 50. In this case, on the top of the assisting process, it is fine to drive the rotation adjusting part 25 in order to pull the operation device 20 out of the moving pathway of the stacker 50. By this, the interference of the stacker 50 and the operation device 20 is prevented.

It is fine that the printing device 11 is configures such that the printing device cannot automatically adjust the rotation positon of the operation device 20. When the printing device 11 is controlled by operating the external device such as the personal computer 100 and the mobile information terminal 101, the user can be located apart from the printing device 11. In this case, possibly the user does not know the rotation position of the operation device 20 of the printing device 11. For this reason, when the housing condition is established by the user operating the external device, and when the stacker automatic housing is performed, the stacker 50 interferes with the operation device 20, and the interference state can be left unknown by the user.

When the housing condition is established by the user operating the external device, it is fine to prevent from performing the stacker automatic housing. By this, it is possible to prevent an event, in which the above mentioned interference state between the stacker 50 and the operation device 20 is left unknown by the user, from happening.

On the other hand, when the user operates the operation device 20, the user is considered to be adjacent to the printing device 11. For this reason, when the interference between the operation device 20 and the stacker 50 happens due to performing the stacker automatic housing, the user can recognize the interference state and resolves the interference state. For this reason, it is fine to permit performing the stacker automatic housing process, as long as the housing condition is established by the user operating the operation device 20.

The medium on which printing is performed and which is fed to the printing area by the feeding mechanism 30 is not limited to the paper sheet, but can be a film made of resin, a metallic sheet, a complex film (laminated film) of resin and metal, fabric, or a ceramic sheet.

The medium on the tray 70 is not limited to the disk, but any printable medium can be placed. For example, such as a metal plate can be placed.

The printing device is not limited to a serial printer, but can be other printers such as a lateral printer, a line printer, a page printer, or a multifunction printer.

The printing method of the printing device is not limited to a liquid ejecting method as represented by a printer with an ink jet method, but can be other printing method such as a dot ink method or a laser method.

Next, a technical idea which can be understood from the above mentioned embodiments and other embodiments is added.

(i) When the housing condition is established while the stacker is in the projecting state, and when the housing the stacker in the device main body is permitted, it is preferable to perform the automatic housing.

By this configuration, it is possible to lower a possibility that, in the state in which the medium is placed on the stacker, the stacker is automatically housed in the device main body.

General Interpretation of Terms

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. Finally, terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents.

What is claimed is:

1. A printing device, comprising:

a printing mechanism configured to print a printing medium fed to a printing area in a device main body;

a stacker configured to receive the printing medium discharged from the printing area;

a drive device configured to cause a state of the stacker to be a housed state in which the stacker is housed in the device main body and a projecting state in which the stacker is positioned outside the device main body; and a control device configured to change the state of the stacker from the housed state to the projecting state by controlling the drive device, when a housing condition for housing the stacker in the device main body is established while the state of the stacker is the projecting state, the control device being configured to perform an automatic housing process to change the state of the stacker to the housed state by controlling the drive device, the housing condition including a condition in which a power-off request of the printing device is conducted.

2. A printing device, comprising:

a printing mechanism configured to print a printing medium fed to a printing area in a device main body;

a stacker configured to receive the printing medium discharged from the printing area;

a drive device configured to cause a state of the stacker to be a housed state in which the stacker is housed in the device main body and a projecting state in which the stacker is positioned outside the device main body;

a control device configured to change the state of the stacker from the housed state to the projecting state by controlling the drive device;

a cassette configured to contain the printing medium before printing; and a feeding mechanism configured to feed the printing medium in the cassette to the printing area, the cassette being detachably equipped on the device main body beneath the stacker, and when a housing condition for housing the stacker in the device main body is established while the state of the stacker is the projecting state, the control device being configured to perform an automatic housing process to change the state of the stacker to the housed state by controlling the drive device, the housing condition including a condition that has a possibility in which the cassette is detached from the device main body.

3. The printing device according to claim 2, wherein the housing condition includes a condition in which the cassette contains no printing medium when printing is requested.

4. The printing device according to claim 2, wherein the housing condition includes a condition in which a size of the printing medium requested for printing is different form a size of the printing medium in the cassette.

5. A printing device, comprising:

a printing mechanism configured to print a printing medium fed to a printing area in a device main body;

a stacker configured to receive the printing medium discharged from the printing area the stacker including a guide part configured to guide a tray configured to hold a medium to the printing area;

a drive device configured to cause a state of the stacker to be a housed state in which the stacker is housed in the device main body and a projecting state in which the stacker is positioned outside the device main body; and a control device configured to change the state of the stacker from the housed state to the projecting state by controlling the drive device, when a housing condition for housing the stacker in the device main body is established while the state of the stacker is the projecting state, the control device being configured to perform an automatic housing process to change the state of the stacker to the housed state by controlling the drive device, the printing mechanism being configured to perform printing on the medium held on the tray and guided to the printing area, and the housing condition including a condition in which the printing on the medium held on the tray is requested.

6. The printing device according to claim 1, further comprising an operation device rotatably supported by the device main body, the operation device including an operation part, and a rotation adjusting part configured to adjust a rotation position of the operation device, wherein a rotation trajectory of the operation device is arranged to overlap a moving pathway of the stacker, and when the power-off request of the control device is requested in a state in which the operation device is arranged on the moving pathway of the stacker, the control device is configured to rotate the operation device until being off the moving pathway of the stacker by controlling the rotation adjusting part to perform the automatic housing process.

7. The printing device according to claim 5, further comprising an operation device rotatably supported by the device main body, the operation device including an operation part, and a rotation adjusting part configured to adjust a rotation position of the operation device, wherein a rotation trajectory of the operation device is arranged to overlap a moving pathway of the stacker, and when printing to the medium held on the tray is requested, the control device is configured to maintain a position of the operation device off the moving pathway of the stacker by controlling the rotation adjusting part until the automatic hosing process and a printing process to print on the medium held on the tray are finished.

* * * * *